US006386959B2

(12) United States Patent
Uruburu

(10) Patent No.: US 6,386,959 B2
(45) **Date of Patent: *May 14, 2002**

(54) FEEDING SYSTEM FOR ELECTRO-CHEMICALLY POLISHING CONTACT TIPS

(75) Inventor: Philip G. Uruburu, Central Islip, NY (US)

(73) Assignees: Micro Contacts Inc., Hicksville, NY (US); Point Technology, Inc., Boulder, CO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/229,718

(22) Filed: Jan. 13, 1999

(51) Int. Cl.[7] ..... B65P 73/02; B24B 31/00
(52) U.S. Cl. ..... 451/107; 242/538.2
(58) Field of Search ..... 451/107; 242/538.2, 242/538.3; 206/717

(56) References Cited

U.S. PATENT DOCUMENTS

| | | | | | |
|---|---|---|---|---|---|
| 2,434,286 | A | | 1/1948 | Pfann | 204/142 |
| 2,628,936 | A | | 2/1953 | Albano | 204/142 |
| 2,721,838 | A | | 10/1955 | Visser | 204/142 |
| 2,811,702 | A | * | 10/1957 | Narozny | 339/220 |
| 3,550,856 | A | * | 12/1970 | Wise et al. | 339/276 |
| 3,606,000 | A | * | 9/1971 | Wise | 206/56 |
| 3,666,090 | A | * | 5/1972 | Johnson et al. | 206/56 |
| 4,021,095 | A | * | 5/1977 | Kinkaid et al. | 339/276 |
| 4,044,888 | A | * | 8/1977 | Schachter | 206/330 |
| 4,242,535 | A | * | 12/1980 | Defibaugh et al. | 174/88 |
| 4,375,396 | A | | 3/1983 | Green et al. | 204/129.55 |
| 4,480,150 | A | * | 10/1984 | Jones et al. | 174/52 |
| 4,600,971 | A | * | 7/1986 | Rose et al. | 361/421 |
| 4,611,262 | A | * | 9/1986 | Galloway et al. | 361/421 |
| 4,612,084 | A | | 9/1986 | Schmolke | 156/639 |
| 4,752,367 | A | | 6/1988 | Vishnitsky | 204/129.5 |
| 4,949,455 | A | | 8/1990 | Nakamura et al. | 29/843 |
| 5,189,278 | A | | 2/1993 | Frietsch | 219/121.66 |
| 5,190,463 | A | | 3/1993 | Datta et al. | 439/74 |
| 5,725,930 | A | * | 3/1998 | Ziberna | 428/131 |

* cited by examiner

*Primary Examiner*—Allen Ostrager
*Assistant Examiner*—William Hong
(74) *Attorney, Agent, or Firm*—Jay H. Maioli

(57) ABSTRACT

Electro-chemical polishing of fine wire contacts is facilitated by welding the wire contacts to a mounting element on a continuous, flexible, metal strip. The assembled contact strip is wound on a spool and transported to the electro-chemical polishing site where the contact strip is drawn into the polishing site at a constant rate under the control of a microprocessor. The progress of the assembled contact strip is monitored by metering rollers and pulse generators that inform the microprocessor of the drive speed of the assembled contact strip. The controller then provides signals to control the take-up and supply spools to ensure that a proper tip polishing operation is carried out.

21 Claims, 4 Drawing Sheets

FEEDING SYSTEM FOR ELECTRO-CHEMICALLY POLISHING CONTACT TIPS

BACKGROUND OF THE INVENTION

1. Field of the Invention

This invention relates to a system for making electrical contacts available for an electrochemical polishing operation and, more particularly, to providing contacts arranged on a metal strip for provision to the electro-chemical polishing operation.

2. Description of Background

The use of very fine wires as electrical contacts in positional encoders, in slip-ring assemblies, precision potentiometers, sensors, or the like is known. It is further known that the contact end of each of such fine wires must be polished in order to eliminate any burrs or the like that would decrease the contact area between the contact and its contact surface. Such polishing is also required to cut down on the extent that the wire contact abrades the mating electrical contact surface.

One known approach to smoothing or rounding off of the ends of very small diameter wires or springs is disclosed in U.S. Pat. No. 5,189,278 in which a laser beam is used to irradiate the ends of the wire or spring so that the end is melted somewhat. While some advantageous results are had by this approach, the melting of the end of the wire or spring results in a loss of temper of the metal. Moreover, in order to properly irradiate the end of the wire with the laser beam, the wire must be separated by more than a nominal distance from its adjacent wire or spring, so that embodiments in which multiple springs are arranged side-by-side in contact with each other are not available for use with the laser technique described in the above-mentioned U.S. patent.

Another approach to smoothing metal objects is known as electro-chemical smoothing, whereby a surface of a conductive metal part can have the burrs removed. One technique for performing such a function is described in U.S. Pat. No. 4,752,376. Nevertheless, application of the electro-chemical smoothing process to extremely fine wire contacts poses difficulties in the implementation because the fine wire assemblies are difficult to handle.

OBJECTS AND SUMMARY OF THE INVENTION

Accordingly, it is an object of the present invention to provide a system whereby the end surfaces of very fine gauge wires forming metal spring contacts can be polished and that can eliminate the above-noted defects inherent in the prior art.

Another object of the present invention is to provide a system for continuous polishing or smoothing of the tips of fine gauge wire electrical contacts mounted on a thin, flexible metal strip for ease of transport and polishing in an electro-chemical polishing operation.

In accordance with an aspect of the present invention, small diameter wire contacts are fixed onto a flexible metal strip that is wound on a spool and transported to an appropriate location whereat an electro-chemical polishing operation is performed on the tips of the wire contacts in a continuous fashion. The contacts and wire strip are then wound up again on a spool for transport to the ultimate manufacturing location. A metering operation takes place to control the supply and take-up spools under control of a microprocessor that permits various inputs by the user of the system.

In accordance with another aspect of the present invention, small diameter wire contacts are fixed onto a flexible metal strip and transported to an appropriate location whereat short lengths of the flexible metal strip are fed to where an electro-chemical polishing operation is performed. The strips with the polished wire contacts are then collected for subsequent use.

The above and other objects, features, advantages of the present invention will become apparent from the following detailed description of illustrative embodiments thereof to be read in conjunction with the accompanying drawings.

DETAILED DESCRIPTION OF PREFERRED EMBODIMENTS

Figure 1:
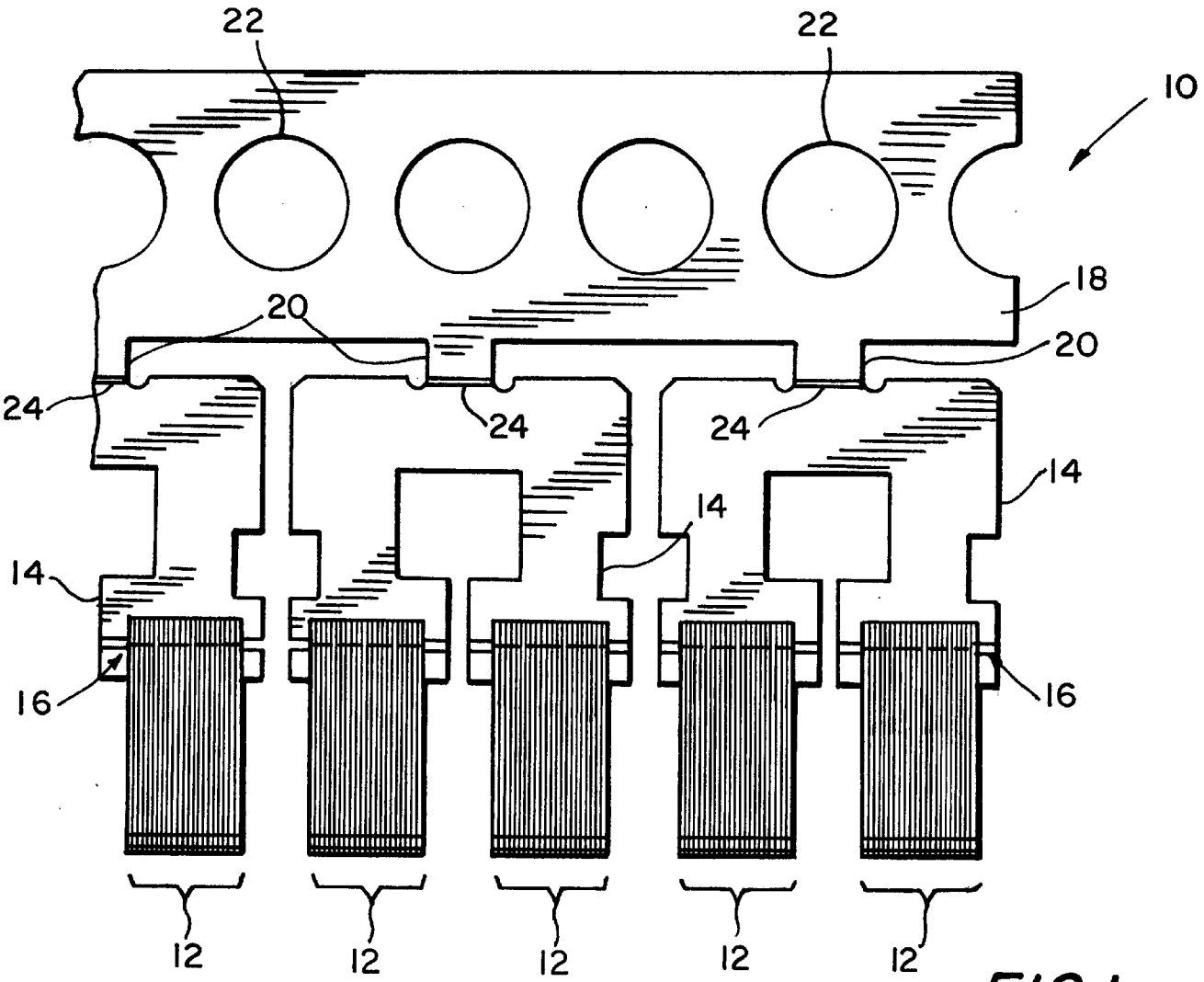
FIG. 1 is a front elevational view of a portion of a flexible metal strip having small diameter contact wires attached thereto.

FIG. 1 shows a portion of a strip of electrical contacts having been previously assembled. More particularly, the assembled contact strip 10 includes a group of fine diameter contact wires shown generally at 12. In this case the wires are of a diameter of approximately 0.003 inches and are formed of palladium/silver alloy. In each of the groups 12, there are twenty-two wires arranged side-by-side so that they are in contact with each other. Each group of wires is welded to a metal holder portion forming a mounting element 14 that is a thin gauge metal spring formed of a tempered copper or nickel based alloy. In addition, various other metal alloys can be used. While in this case it is palladium/silver alloy on a copper base strip the wires could be tungsten or stainless steel or the like on a base strip formed of various other metals.

As seen in FIG. 1, in this particular construction there are two groups of spring wires 12 attached to each mounting element 14, which is in the form of a U-shaped element. One group of wires 12 is welded to each arm of the mounting element 14 at a location shown generally at 16 in FIG. 1.

The mounting elements 14 are in turn attached to a band of the same spring-like material 18 at attachment elements 20. The band 16 is provided with sprocket holes, shown typically at 22, that are precisely located along the length thereof. The mounting elements 14 and the band 18 need not be separate elements, and the mounting elements and band can be integrally formed as one piece.

After the manufacturing and polishing operations have been performed on the spring wires 12 and the assembled contact strip 10 conveyed to the final assembly point, the wires 12 and mounting elements 14 may be separated from the band 18 by separating the mounting elements 14 from the attachment elements 20 at a so-called score line 24 by bending or severing. The detachment of the mounting elements 14 from the band 18 may occur at the site of the end-user of the contacts by means of an automated assembly machine.

There are various configurations that the spring contact assemblies can assume, and the showing at 10 in FIG. 1 is only one example of the number of wires per mounting element, as well as the configuration of the mounting element itself.

Figure 2:
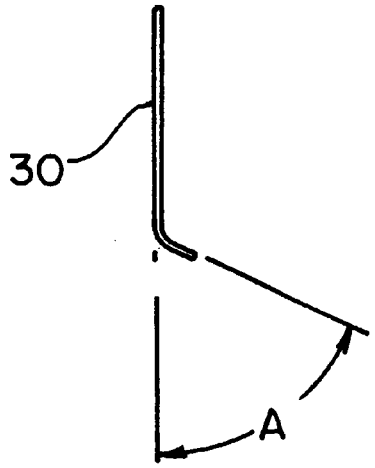
FIG. 2 is a view of the tip portion of one of the contact wires shown in FIG. 1 that is bent at a predetermined angle.

FIG. 2 shows a single wire 30 that makes up the group of wire contacts 12 shown in FIG. 1. This wire 30 is bent at the head end through an angle A, which can typically be approximately 70°. Alternatively, the wire contacts can be supplied straight for subsequent bending after polishing.

Figure 3:
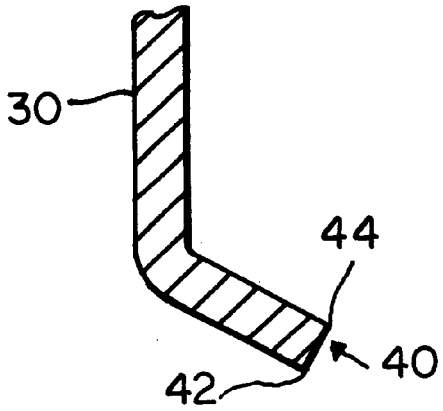
FIG. 3 is an enlarged cross-sectional view through the contact wire of FIG. 2 prior to polishing.

FIG. 3 is a close-up view in cross-section of the wire 30 of FIG. 2 showing that at the end portion 40 sharp corners such as at 42 and burrs such as at 44 caused by the manufactured process are originally present. It is these sharp corners 42 and burrs 44 that are desired to be eliminated from the finished product.

Figure 4:
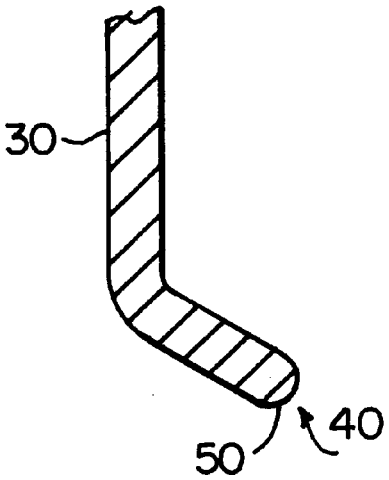
FIG. 4 is a cross-sectional view of the contact wire of FIG. 3 after having undergone an electrochemical polishing operation.

In that regard, FIG. 4 shows the wire 30 of FIG. 3 having an end portion 40 with a smoothly rounded contour 50 in which the sharp corners 42 and burrs 44 have been eliminated. This is made possible by performing the operations known as electrochemical polishing, which have been discussed hereinabove.

Figure 5:
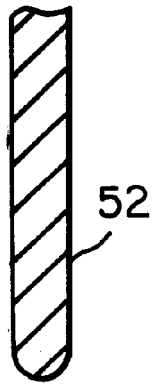
FIG. 5 is an enlarged cross-section view of a contact wire that is straight after having undergone an electro-chemical polishing operation.

FIG. 5 shows a close-up view in cross-section of a single wire 52 that is not bent but is straight. A group of these wires would be used to make up the contact group 12 of FIG. 1. This wire 52 has already been polished and the burrs and sharp corners have been removed and is then ready to be bent through any angle required by the particular application.

Figure 6:
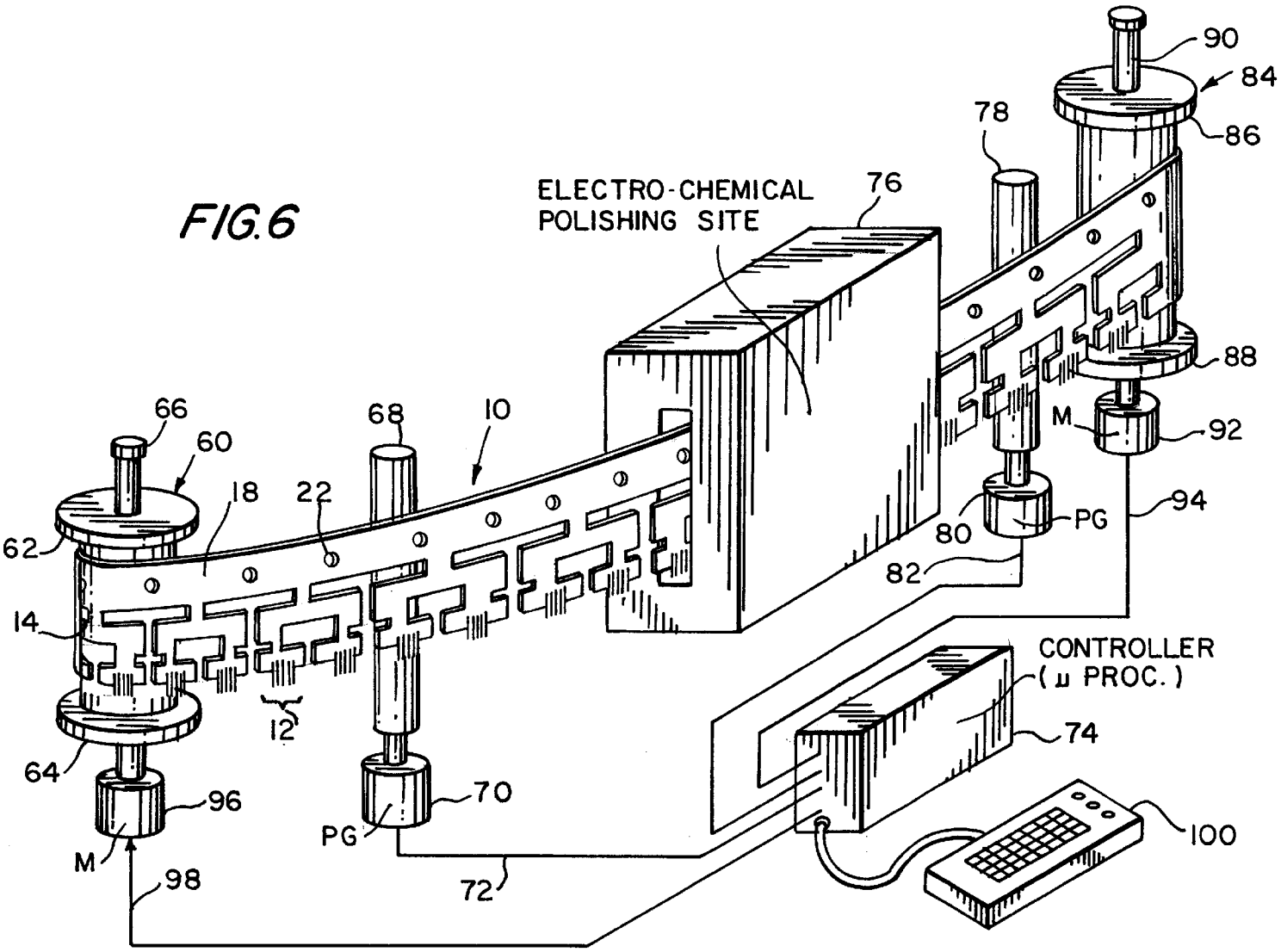
FIG. 6 is a schematic representation of the electro-chemical polishing operation according to an embodiment of the present invention.

FIG. 6 is a schematic representation of an embodiment of the present invention in which the assembled contact strip 10 bearing the mounting elements 14 and contact wires 12 attached to the mounting strip 18 is provided to the electrochemical processing site.

The assembled contact strip 10 is wound about a supply spool 60 that has upper and lower flanges 62 and 64, respectively. The supply spool 60 is mounted on a spindle 66 that is provided with suitable mounting elements to permit the supply spool 60 to be rotatably mounted thereon. The assembled contact strip 10 is then passed over a metering roller 68 that has a sprocket or the like, not shown, that engages with the sprocket holes 22 of the assembled contact strip 10. Alternatively, the metering roller could be a soft rubber roller that is rotated by friction with the assembled contact strip 10. The metering roller 68 is attached to a pulse generator 70 that provides output pulses on line 72 fed to the system controller 74, which may comprise a microprocessor. The assembled contact strip 10 is then passed into an electro-chemical polishing site 76 that performs the electrochemical polishing on the tips of the contact wires, as described above.

Following the polishing operation, the assembled contact strip 10 passes over a second metering roller 78 that has associated therewith a second pulse generator 80 that provides second pulses on line 82 fed to the system controller 74. After passing over the second metering roller 78, which would also include a sprocket, not shown, for interacting with the sprocket holes 22, the assembled contact strip 10 with the polished tips is wound up on a take-up spool 84 that also has upper flange 86 and lower flange 88 for tracking the assembled contact strip 10 as it is wound up. The take-up spool 84 is mounted on a spindle 90 that is driven by a take-up motor 92. The take-up motor 92 is controlled by a signal on line 94 from the system controller 74.

In order to provide proper tension on the band as it is fed or drawn into the electro-chemical polishing site 76, a torque motor 96 can be provided on the supply spindle 66 to provide appropriate tension on the assembled contact strip 10. Torque motor 94 is controlled by a signal on line 98 from the controller 74. Alternatively, a mechanical tensioning system, such as a brake band, could be provided at the take-up reel 60 to provide the appropriate tension on the assembled contact strip 10.

Various changes in speed as well as stopping and starting are controlled by the controller 74 by way of the user of the system operating a keyboard 100 that is electrically connected to the system controller 74.

Accordingly, by use of the system shown in FIG. 6, it is possible to provide electro-chemical polishing to small diameter wires 12 mounted on a flexible band 18 that can be drawn through an electro-chemical polishing site 76 for polishing the tips of the fine diameter wires forming the contacts 12 with the result as shown in FIG. 4 or FIG. 5, for example.

Although the above description was presented in regard to a continuous contact strip, the present invention also contemplates the use of relatively short lengths of the strip. Such an embodiment is shown FIG. 7, in which the contacts are formed as specific strip lengths. More particularly, an assembled contact strip 110 includes a group of fine diameter wires, shown typically at 112. Each group of wires is welded to a metal holder portion 114.

A few of the mounting elements 14, in this case three, are attached to a short length or strip of spring-like material 118 at attachment elements 120. The strip 118 can have sprocket holes 122 formed therein. Although this embodiment shows three mounting elements 114 attached to the strip 118 fewer or more mounting elements could be employed with the strip length changing attordingly.

Figure 7:
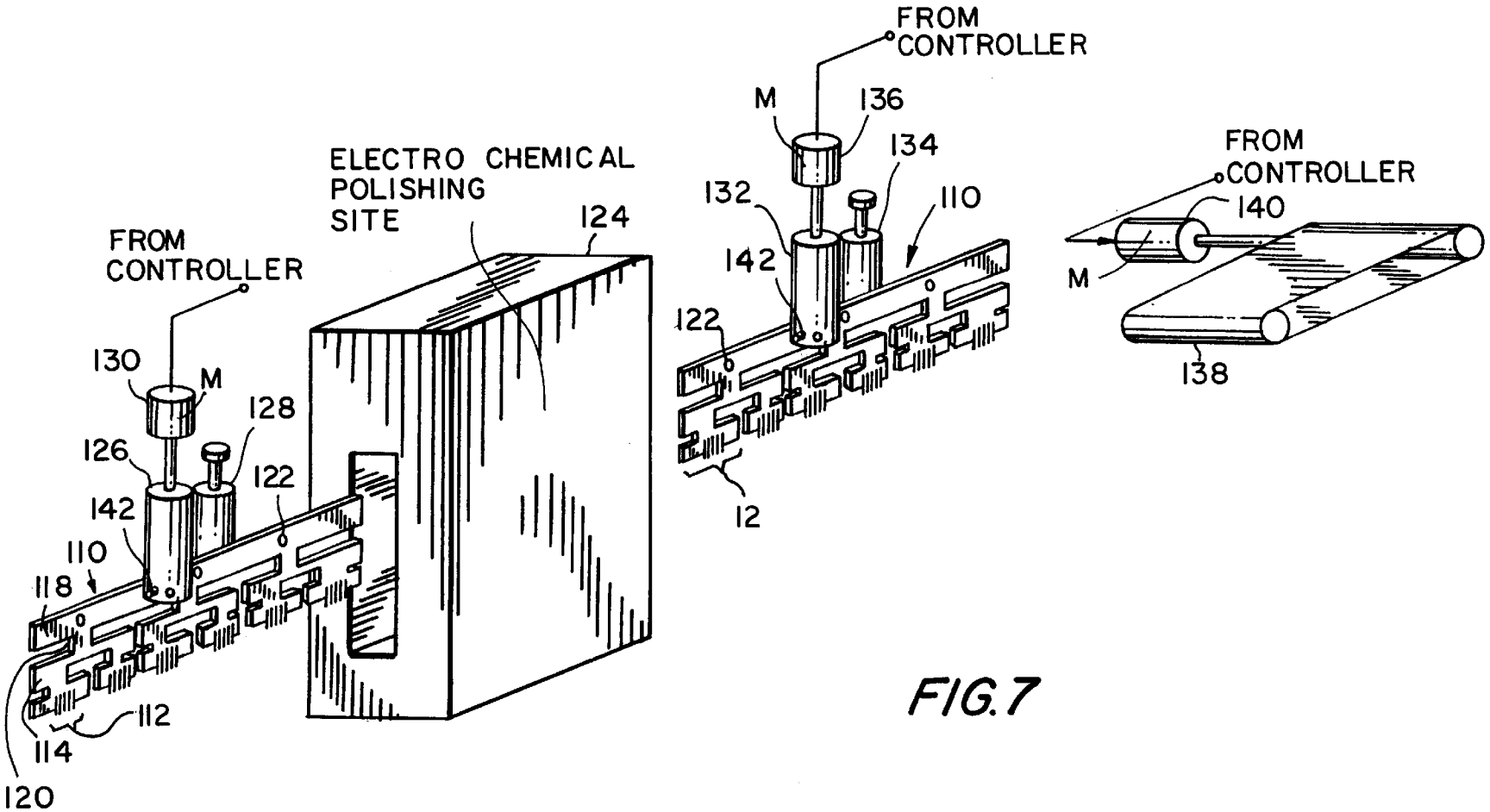
FIG. 7 is a schematic representation of the electro-chemical polishing operation according to another embodiment of the present invention.

The materials used in the contact strip 110 of FIG. 7 can be the same as those discribed above in relation to FIG. 1.

The assembled contact strip 110 is fed to an electroochemical polishing site 124 by a drive roller pair that includes a drive roller 126 and an idler roller 128. The drive roller 126 is driven by a motor 130 that is controlled by a system controller, not shown, such as controller 24 in the system of FIG. 6.

The contact strip 110 is thus fed into the polishing site 124 where it is handled in a similar fashion as by the input system that is shown and the electro-chemical tip polishing is performed.

Following the polishing operation the polished contact strip 110 is fed to the nip of a pair of output rollers that include a drive roller 132 and idler roller 134. The drive motor 132 is driven by a motor 136 under control of the system controller, not shown.

The output rollers 132, 134 then transport the contact strip 110 to a collection location, such as a conveyor belt 138 driven by a motor 140 under control of the system controller, not shown.

The input rollers and output rollers can transport the contact strips 110 by friction or drive pins, shown typically at 142, can be provided on the drive rollers 126, 132 for interaction with the sprocket holes 122 formed in the metal strip 118. Nevertheless, because the rate of passage of the contact strips 110 through the polishing site is not absolutely set by the input and output rates, the input and output drive rates can be met using friction drive rollers.

It will be understood, of course, that various modifications and alterations can be made to the embodiment described above without departing from the spirit and scope of the present invention, which is to be defined by the appended claims.

What is claimed is:

1. A system for providing thin wire contacts to an electro-chemical polishing operation, the system comprising:

a flexible metal strip having a plurality of detachable metal mounting elements formed along a length of said strip;

a plurality of thin wire contacts arranged in a plurality of groups, one or more of said groups being attached by welding to each of said plurality of metal mounting element formed along said flexible metal strip;

a spool having wound thereon said flexible metal strip having said plurality of groups of thin wire contacts separably attached by welding to said plurality of metal mounting elements; and means for uniformly moving said flexible metal strip having said plurality of groups of thin wire contacts separably attached by welding to said plurality of metal mounting elements from said spool into and through an electro-chemical polishing operation site, whereat tips of said plurality of tin wire contacts are polished.

2. The system for providing thin wire contacts to an electro-chemical polishing operation according to claim 1, wherein said spool forms a supply spool and further comprising a take-up spool for taking up said flexible metal strip having said plurality of thin wire contacts attached thereto following the electro-chemical polishing operation.

3. The system for providing thin wire contacts to an electro-chemical polishing operation according to claim 2, wherein said means for uniformly moving comprises:

a controller;

a drive motor for driving said take-up spool under control of said controller; and a metering roller for detecting a drive rate of said flexible metal strip having said plurality of thin wire contacts separably attached thereto for providing a pulsed signal to said controller indicating said drive rate.

4. The system for providing thin wire contacts to an electro-chemical polishing operation according to claim 3, further comprising means for applying a tension to said flexible metal strip having said plurality of thin wire contacts separably attached thereto while moving into and through said electro-chemical polishing operation site.

5. The system for providing thin wire contacts to an electro-chemical polishing operation according to claim 1, wherein said plurality of thin wire contacts in each of said groups are attached to said flexible metal strip in side-by-side arrangement and in physical contact with each other.

6. The system for providing thin wire contacts to an electo-chemical polishing operation according to claim 1, wherein said plurality of thin wire contacts in each of said groups are attached to said flexible metal strip in mutually spaced-apart relationship.

7. The system for providing thin wire contacts to an electro-chemical polishing operation according to claim 1, wherein free ends of said plurality of thin wire contacts are bent at a predetermined angle.

8. The system for providing thin wire contacts to an electro-chemical polishing operation according to claim 1, wherein free ends of said plurality of thin wire contacts are straight.

9. A system for providing thin wire contacts to an electro-chemical polishing site for tip polishing, the system comprising:

a flexible metal strip having a plurality of detachable metal mounting elements formed at regular intervals along a length of said strip;

a plurality of thin spring wires arranged in a plurality of groups, at least one of said groups being attached by welding to each of said plurality of detachable metal mounting elements formed on said flexible metal strip;

a supply spool having wound thereon said flexible metal strip having said plurality of groups of thin spring wires attached to said plurality of detachable metal mounting elements;

means for uniformly moving said flexible metal strip having said plurality of groups of thin spring wires attached to said plurality of detachable metal mounting elements from said spool into and through an electro-chemical tip polishing operation site, whereat tips of said plurality of thin spring wires ate polished; and a take-up spool for taking up said flexible metal strip having said plurality of groups of thin spring wires attached to said plurality detachable metal mounting elements following the electro-chemical tip polishing operation.

10. The system for providing thin wire contacts to an electro-chemical polishing site for tip polishing according to claim 9, therein said means for uniformly moving comprises:

a system controller;

an input device connected to said controller for providing commands to said system controller upon operation by a user of the system;

a drive motor for driving said take-up spool under control of said system controller; and a metering roller for detecting a drive rate of said flexible metal strip having said plurality of thin spring wires attached thereto for providing a pulsed signal to said system controller indicating said drive rate.

11. The system for providing thin wire contacts to an electro-chemical polishing site for tip polishing according to claim 10, further comprising means for applying a tension to said flexible metal strip having said plurality of thin spring wires attached thereto while moving into and through said electro-chemical tip polishing operation site.

12. The system for providing thin wire contacts to an electro-chemical polishing site for tip polishing according to claim 9, wherein said plurality of thin wire contacts in each group are attached to said flexible metal strip in side-by-side arrangement and in physical contact with each other.

13. The system for providing thin wire contacts to an electro-chemical site for tip polishing according to claim 9, wherein said plurality of thin wire contacts in each group are attached to said flexible metal strip in a mutually spaced-apart relationship.

14. The system for providing thin wire contacts to an electro-chemical site for tip polishing according to claim 9, wherein free ends of said plurality of thin wire contacts are bent at a predetermined angle.

15. The system for providing thin wire contacts to an electro-chemical polishing site for tip polishing according to claim 9, wherein free ends of said plurality of thin wire contacts are straight.

16. A system for providing thin wire contacts to an electro-chemical polishing operation, the system comprising:

a straight strip formed of flexible metal having a plurality of detachable metal mounting elements arranged at even intervals along a length thereof;

a plurality of thin wire contacts arranged in a plurality of groups, one or more of said groups being attached by welding to each of said plurality of detachable metal mounting elements formed along said straight strip formed of flexible metal;

input means for moving said straight strip formed of flexible metal having said plurality of groups of thin wire contacts attached by welding to said plurality of detachable metal mounting elements into an electro-chemical polishing operation, whereat tips of said plurality of thin wire contacts are polished; and output means for moving said straight strip formed of flexible metal having said plurality of groups of thin wire contacts attached to said detachable metal mounting elements out of the electro-chemical polishing operation site.

17. The system for providing thin wire contacts to an electro-chemical polishing operation according to claim 16, wherein said input means for moving comprises:

a drive roller;

an idler roller in contact with said drive roller; and a drive motor for rotating said drive roller.

18. The system for providing thin wire contacts to an electro-chemical polishing operation according to claim 17, wherein said plurality of thin wire contacts in each of said groups are attached to said straight strip in side-by-side arrangement and in physical contact with each other.

19. The system for providing thin wire contacts to an elecro-chemical polishing operation according to claim 17, wherein said plurality of thin wire contacts in each of said groups are attached to said straight strip in mutually spaced-apart relationship.

20. The system for providing thin wire contacts to an electo-chemical polishing operation according to claim 17, wherein free ends of said plurality of thin wire contacts are bent at a predetermined angle.

21. The system for providing thin wire contacts to an electro-chemical polishing operation according to claim 17, wherein free ends of said plurality of thin wire contacts are straight.

* * * * *